US006986634B2

(12) United States Patent
Westendorf et al.

(10) Patent No.: US 6,986,634 B2
(45) Date of Patent: Jan. 17, 2006

(54) LOADER/ATTACHMENT ASSEMBLY, METHOD FOR USING A LOADER/ATTACHMENT ASSEMBLY, AND COMBINATION MOTOR VEHICLE AND LOADER/ATTACHMENT ASSEMBLY

(75) Inventors: Neal W. Westendorf, Dakota Dunes, SD (US); Joseph W. Langenfeld, Onawa, IA (US)

(73) Assignee: Westendorf Manufacturing Co., Inc., Onawa, IA (US)

( * ) Notice: Subject to any disclaimer, the term of this patent is extended or adjusted under 35 U.S.C. 154(b) by 0 days.

(21) Appl. No.: 10/719,657

(22) Filed: Nov. 21, 2003

(65) Prior Publication Data

US 2005/0111952 A1 May 26, 2005

(51) Int. Cl.
*E02F 3/627* (2006.01)

(52) U.S. Cl. ..... 414/686; 414/918; 172/273; 172/274

(58) Field of Classification Search ..... 414/686, 414/918; 172/272–275
See application file for complete search history.

(56) References Cited

U.S. PATENT DOCUMENTS

| | | | |
|---|---|---|---|
| 2,326,338 | A | 8/1943 | Drott et al. |
| 2,812,595 | A | 11/1957 | Drott et al. |
| 3,077,999 | A | 2/1963 | Svoboda |
| 3,209,474 | A | 10/1965 | Artman |
| 3,243,905 | A | 4/1966 | Ulrich |
| 3,344,540 | A | 10/1967 | Ulrich |
| 3,455,477 | A | 7/1969 | Blair |
| 3,512,665 | A | 5/1970 | Westendorf |
| 3,701,443 | A | 10/1972 | Lely |
| 3,991,890 | A | 11/1976 | Frank |
| 4,033,469 | A | 7/1977 | Frank |
| 4,051,962 | A | 10/1977 | Westendorf |
| 4,085,856 | A | 4/1978 | Westendorf |
| 4,345,870 | A | 8/1982 | Anderson et al. |
| 4,538,955 | A | 9/1985 | Langenfeld et al. |
| 4,565,485 | A | 1/1986 | Wilman |
| 4,566,844 | A | 1/1986 | Campin |
| 4,606,692 | A | 8/1986 | Langenfeld et al. |
| 4,787,811 | A | 11/1988 | Langenfeld et al. |

(Continued)

OTHER PUBLICATIONS

"Kubota Diesel Tractor", Catalog No. 3079-01-US, 12 Pages, Feb. 1990.

(Continued)

*Primary Examiner*—Donald W. Underwood
(74) *Attorney, Agent, or Firm*—Merchant & Gould P.C.

(57) ABSTRACT

A loader/attachment assembly is provided. The loader/attachment assembly can be referred to as a loader/bucket assembly when the attachment is a bucket. The loader/attachment assembly can include a bucket and a loader assembly. The bucket includes a bucket attachment region and a bucket face opening. The loader assembly includes a left boom and a right boom. The left boom includes a left first boom end constructed for attachment to a left bracket assembly on a motor vehicle, a left second boom end attached to the bucket attachment region, a left lift cylinder, and a left attachment cylinder. The right boom includes a right first boom end constructed for attachment to a right bracket assembly on a motor vehicle, a right second boom end attached to the bucket attachment region, a right lift cylinder, and a right attachment cylinder. The loader/attachment assembly is constructed so that the bucket rotates relative to the loader assembly so that when the loader/attachment assembly is provided in a storage position, the bucket face opening rests on the ground. A combination motor vehicle and loader/attachment assembly and a method for using a loader/attachment assembly are provided.

14 Claims, 8 Drawing Sheets

U.S. PATENT DOCUMENTS

| | | | | |
|---|---|---|---|---|
| 4,790,084 | A | | 12/1988 | Anderson et al. |
| 4,797,051 | A | | 1/1989 | Langenfeld et al. |
| 4,859,130 | A | | 8/1989 | Langenfeld et al. |
| 4,890,400 | A | | 1/1990 | Long |
| 4,915,575 | A | | 4/1990 | Langenfeld et al. |
| 4,930,974 | A | | 6/1990 | Langenfeld et al. |
| 4,968,213 | A | | 11/1990 | Langenfeld et al. |
| 4,995,760 | A | | 2/1991 | Probst et al. |
| 5,121,557 | A | | 6/1992 | Moore |
| 5,232,330 | A | * | 8/1993 | Rae et al. ..... 414/686 |
| 5,387,076 | A | | 2/1995 | Fuzzen |
| 5,466,113 | A | | 11/1995 | Norberg |
| 5,785,328 | A | | 7/1998 | Eckloff |
| 5,997,237 | A | | 12/1999 | Langenfeld et al. |
| 6,142,724 | A | | 11/2000 | Hirooka et al. |
| 6,582,177 | B1 | | 6/2003 | Westendorf et al. |
| 6,663,337 | B2 | | 12/2003 | Westendorf et al. |

OTHER PUBLICATIONS

"Bush Hog Front End Loaders", 12 Pages, date unknown.

"Bush Hog QT Series Front End Loaders". 16 Pages, date unknown.

* cited by examiner

LOADER/ATTACHMENT ASSEMBLY, METHOD FOR USING A LOADER/ATTACHMENT ASSEMBLY, AND COMBINATION MOTOR VEHICLE AND LOADER/ATTACHMENT ASSEMBLY

FIELD OF THE INVENTION

The invention relates to a loader/attachment assembly, a method for using a loader/attachment assembly, and a combination motor vehicle and loader/attachment assembly. The loader/attachment assembly can rest on the ground in a storage position by balancing on the attachment, and without the use of a support stand. When the attachment is a bucket, the loader/attachment assembly can rest in a storage position on the open face of the bucket.

BACKGROUND OF THE INVENTION

Conventional front-end loaders have a pair of boom assemblies that have rearward ends that pivotally attach to a tractor, and forward ends that pivotally attach to an attachment. Exemplary attachments found conventional front end loaders include buckets, clam shells, plows, fork lifts, bale spears, etc. Hydraulic cylinders are provided for operating the front-end loaders and the attachments. Hydraulic lines can be found extending along the exterior of the front-end loaders for powering the hydraulic cylinders.

Exemplary front end loaders are described by U.S. Pat. No. 3,512,665 to Westendorf; U.S. Pat. No. 4,085,856 to Westendorf; U.S. Pat. No. 4,787,811 to Langenfeld et al.; U.S. Pat. No. 4,051,962 to Westendorf, U.S. Pat. No. 4,606,692 to Langenfeld et al.; and U.S. Pat. No. 4,930,974 to Langenfeld et al.

Several front end loaders have been designed having the stand that holds the front end loader in a storage position to assist with mounting and dismounting of the front end loader from a tractor. Exemplary front end loaders having a stand are described by U.S. Pat. No. 3,991,890 to Frank; U.S. Pat. No. 4,033,469 to Frank; U.S. Pat. No. 4,345,870 to Anderson et al.; and U.S. Pat. No. 6,142,724 to Hirooka et al.

SUMMARY OF THE INVENTION

A loader/attachment assembly is provided according to the invention. The loader/attachment assembly can be referred to as a loader/bucket assembly when the attachment is a bucket. The loader/attachment assembly can include a bucket and a loader assembly. The bucket includes a bucket attachment region and a bucket face opening. The loader assembly includes a left boom and a right boom. The left boom includes a left first boom end constructed for attachment to a left bracket assembly on a motor vehicle, a left second boom end attached to the bucket attachment region, a left lift cylinder, and a left attachment cylinder. The right boom includes a right first boom end constructed for attachment to a right bracket assembly on a motor vehicle, a right second boom end attached to the bucket attachment region, a right lift cylinder, and a right attachment cylinder. The loader/attachment assembly is constructed so that the bucket rotates relative to the loader assembly so that when the loader/attachment assembly is provided in a storage position, the bucket face opening rests on the ground.

The loader/attachment assembly can include hydraulic lines extending through the left boom and the right boom for operating the left lift cylinder, the left attachment cylinder, the right lift cylinder, and the right attachment cylinder. In addition, the loader assembly can include at least one boom connector connecting the left boom to the right boom, and the hydraulic lines can be provided extending through the boom connector.

A combination motor vehicle and loader/attachment assembly is provided according to the invention. An exemplary motor vehicle includes a tractor. The loader/attachment assembly includes a left bracket assembly attached to the left side of the motor vehicle, and a right bracket assembly attached to the right side of the motor vehicle. The left boom includes a left tower that engages the left bracket assembly, and the right boom includes a right tower that engages the right bracket assembly. Hydraulic lines can be provided extending from the tractor to the left tower and the right tower and through the left boom and the right boom. The motor vehicle can be a tractor.

A method for using a loader/attachment assembly is provided according to the invention. The method for using a loader/attachment assembly can include a method for attaching a loader/attachment assembly to a motor vehicle and/or a method for detaching a loader/attachment assembly from a motor vehicle. When attaching the loader/attachment assembly to a motor vehicle, the loader/attachment assembly can be provided in a storage position where the bucket face opening rests on the ground and the left second boom end and the right second boom end extend into the air for attachment to the left bracket assembly and the right bracket assembly provided on a motor vehicle. In addition, the motor vehicle can be advanced into the loader/attachment assembly so that the left second boom end engages the left bracket assembly, and the right second boom end engages the right bracket assembly. The left second boom end and the right second boom end can lock onto the left bracket assembly and the right bracket assembly, respectively. In addition, hydraulic lines can be manually attached. When detaching the loader/attachment assembly from a motor vehicle, the loader/attachment assembly can be provided in a storage position, the left second boom end and the right second boom end can be released from the left bracket assembly and the right bracket assembly, respectively, and the motor vehicle can be backed away from the loader/attachment assembly. The loader/attachment assembly can be provided in the storage position where the left second boom end and the right second boom end extend into the air, without the use of a structure such as a stand supporting the left second boom end and the right second boom end. That is, the loader/attachment assembly can be constructed to balance on the bucket without the use of an additional support structure.

DETAILED DESCRIPTION OF THE INVENTION

Figure 1:
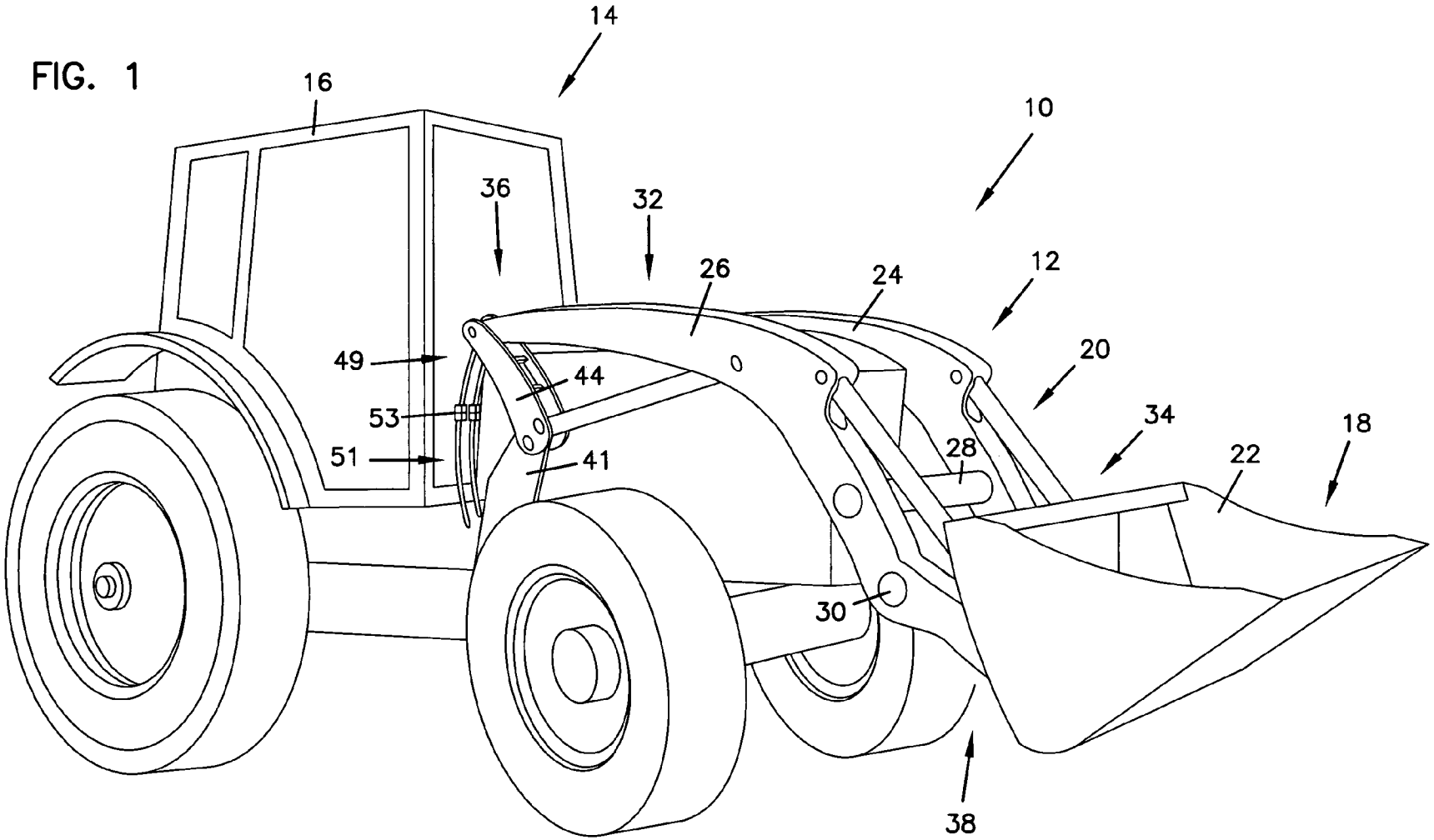
FIG. 1 is a perspective view of a tractor and a loader/attachment assembly according to the principles of the invention.

A combination motor vehicle and loader/attachment assembly is shown in FIG. 1 at reference number 10. The combination motor vehicle and loader/attachment assembly 10 includes a loader/attachment assembly 12 attached to a motor vehicle 14. The motor vehicle shown is a tractor 16. Exemplary other motor vehicles that can be used with the loader/attachment assembly 12 include trucks and converted combines. The loader/attachment assembly 12 includes an attachment 18 and a loader assembly 20. The attachment 18 can be any attachment that provides for beneficial use when attached to the loader/attachment assembly 12. Preferably, the attachment 18 is an attachment that allows the loader/attachment assembly 12 to balance in a storage position without the need of a stand to hold it in place. In general, many prior art loaders include a stand that supports the loader in a storage position. The stands provided on such loaders allow the loaders to be arranged in a configuration that provides for relatively easy mounting and dismounting from a motor vehicle. The loader/attachment assembly according to the invention can be provided without a stand for supporting the loader/attachment assembly in a storage position. The loader/attachment assembly 12 can be referred to as a freestanding loader/attachment assembly because it is capable of balancing on the attachment 18 and in a storage position without the need of a stand to hold it in place. The attachment 18 shown in FIG. 1 is a bucket 22. It is expected that other attachments can be provided for use according to the invention including clam shells, plows, fork lifts, bale spears, etc.

The loader/attachment assembly 12 includes a loader assembly 20 and an attachment 18. The attachment 18 is shown in FIG. 1 as a bucket 22. The loader assembly 20 and the bucket 22 are attached in a manner that allows the bucket 22 to rotate relative to the loader assembly 20. The loader assembly 20 includes a left boom 24 and a right boom 26. The left boom 24 and the right boom 26 can be attached together by the boom connectors 28 and 30. The boom connectors can be referred to as cross bars. In addition, the left boom 24 and the right boom 26 can be attached together as a result of the bucket 22 and the motor vehicle 14. The left boom 24 includes a left first boom end 32 and a left second boom end 34. The right boom 26 includes a right first boom end 36 and a right second boom end 38. The left first boom end 32 and the right first boom end 36 attach to the left bracket assembly 40 (FIGS. 3 and 5–7) and the right bracket assembly 41, respectively, and the bracket assemblies 40 and 41 are attached to the motor vehicle 14. The left second boom end 34 and the right second boom end 38 attach to the bucket 22. The bracket assemblies 40 and 41 can be provided as part of the loader/attachment assembly 12.

Figure 2:
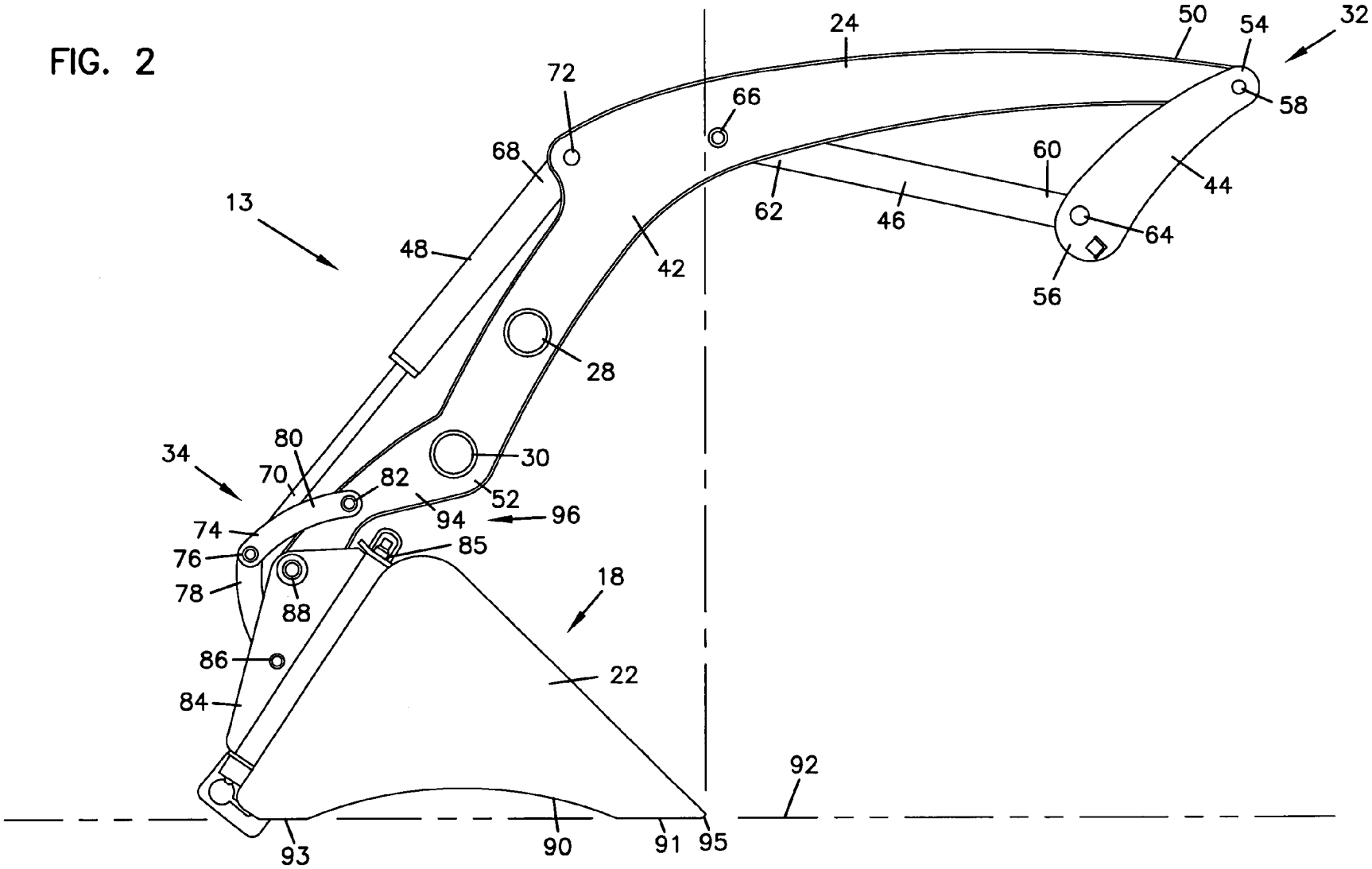
FIG. 2 is a side view of the loader assembly and bucket of FIG. 1 in a storage position.

The loader/attachment assembly 12 can be provided so that it balances on the attachment 18 without the use of a stand when provided in a storage position as shown in FIG. 2. It should be understood that the storage position refers to the storage configuration of the loader/attachment assembly 12 after detachment from a motor vehicle and/or prior to attachment to a motor vehicle where it is ready for convenient attachment to a motor vehicle. That is, the left first boom end 32 and the right first end 36 are available in a position for convenient attachment to the left bracket assembly and the right bracket assembly, respectively. By adjusting the construction and/or the weight distribution of various components of the loader/attachment assembly 12, the loader/attachment assembly 12 can be constructed so that it balances in a storage position on the attachment 18 without the need for a stand.

The loader/attachment assembly 12 can be designed to provide a loader/attachment assembly that is free-standing by controlling the weight distribution and/or by controlling the structure. In the case of weight distribution, it has been found that by focusing the weight forward or closer to the attachment 18 and away from the left first boom end 32 and the right first boom end 36, it is possible to help balance the loader/attachment assembly in a storage position where the weight is generally closer to the ground upon which the attachment 18 rests. Exemplary weight distributions that are more favorable to balancing the loader/attachment assembly in a storage position include providing a lighter tower, providing the boom connectors 28 and 30 closer to the attachment 18, and providing an attachment 18 that is sufficiently heavy. The structure of the loader/attachment assembly can be designed to help maintain the loader/attachment assembly in a storage position. For example, the attachment 18 can be provided as a bucket 22 having a relatively wide face that, when placed on the ground, provides a relatively stable surface. In addition, the left second boom end 34 and the right second boom end 38 can be constructed to allow the bucket 22 to rotate to an extent that allows the bucket face to rest on the ground and provide a broad area of support. These features that can be relied upon for providing the loader/attachment assembly 12 as a freestanding loader/attachment assembly when provided in a storage position, are explained below in more detail.

Now referring to FIG. 2, the loader/attachment assembly 12 is shown in a storage position 13. The loader/attachment assembly 12 is shown in the context of the left boom 24 attached to the bucket 22. It should be understood that the right boom 26 can include corresponding structural components. That is, many of the components of the left boom 24 can find a similar structure on the right boom 26. Many of the views presented in the figures are either left side views or right side views. Many of the structures found on the left side or the right side of the loader/attachment assembly 12 can be found on the corresponding side. That is, much of the structure found on the left boom arm 24 can also be found on the right boom arm 26, and much of the structure found on the left bracket assembly 40 can be found on the right bracket assembly 41.

The left boom 24 includes a boom arm 42, a tower 44, a lift cylinder 46, and an attachment cylinder 48. The boom arm 42 includes a first boom arm end 50 and a second boom arm end 52. The tower 44 includes a first tower end 54 and a second tower end 56. The first boom arm end 50 attaches to the first tower end 54 about the boom arm/tower rotation pin 58. The lift cylinder 46 includes a first lift cylinder end 60 and a second lift cylinder end 62. The first lift cylinder end 60 attaches to the second tower end 56 about the lift cylinder/tower rotation pin 64. The second lift cylinder end 62 attaches to the boom arm 42 at the lift cylinder/boom arm rotation pin 66. The attachment cylinder 48 includes a first attachment cylinder end 68 and a second attachment cylinder end 70. The first attachment cylinder end 68 attaches to the boom arm 42 at the attachment cylinder/boom arm rotation pin 72. The second attachment cylinder end 70 attaches to the bucket linkage 74 at the attachment cylinder/bucket linkage rotation pin 76. The bucket linkage 74 includes a first bucket linkage arm 78 and a second bucket linkage arm 80. The first bucket linkage arm 78 and the second bucket linkage arm 80 can be provided attached to the attachment cylinder/bucket linkage rotation pin 76. The second bucket linkage arm 80 attaches to the second boom arm end 52 at the bucket linkage arm/boom arm rotation pin 82. The first bucket linkage arm 80 attaches to the bucket attachment region 84 of the bucket 22 at the bucket linkage arm/bucket attachment region rotation pin 86. The bucket attachment region 84 attaches to the second boom arm end 52 about the boom arm/bucket attachment rotation pin 88. The right boom 26 can include the same structure as the left boom 24.

The bucket 22 includes the bucket attachment region 84 and a bucket face opening 90. The bucket attachment region 84 can be provided as part of a quick attachment device 85 that attaches to the bucket 22 or it can be provided as a part of the bucket 22 itself. The quick attachment device 85 allows for a relatively quick and convenient attachment and removal of the bucket 22 from the loader assembly 20. Exemplary quick attachment devices are described in U.S. Pat. No. 3,512,665 to Westendorf, U.S. Pat. No. 4,085,856 to Westendorf, U.S. Pat. No. 4,787,811 to Langenfeld et al., U.S. Pat. No. 4,859,130 to Langenfeld et al., U.S. Pat. No. 4,915,575 to Langenfeld et al., and U.S. Pat. No. 4,968,213 to Langenfeld et al. The disclosures of quick attachment devices provided in these patents are incorporated herein by reference. Although the loader/attachment assembly 12 is shown having a quick attachment device, it should be understood that the invention can be practiced without a quick attachment device. That is, the bucket 22 can be attached directly to the first bucket linkage arm 78 and the second boom arm end 52.

The stability of the loader/attachment assembly 12 can be enhanced when provided in the storage position by providing a construction that allows the bucket to rotate backwards so that the bucket face opening 90 rests on the ground 92. It should be understood that the direction "backwards" refers to a counter clockwise rotation of the bucket 22 about the second boom arm end 52 as shown from the perspective in FIG. 2. In other words, a backwards rotation can be characterized as the rotation of the bucket as a result of the extension of the attachment cylinder 48. A forward rotation can be considered the rotation as a result of a retraction of the attachment cylinder 48. The extent of rotation can be provided as a result of the construction of the second boom arm end 52, the bucket linkage 74, and the bucket attachment region 84. The second boom arm end 52 is constructed to include a forward arm 94 that extends the boom arm/bucket attachment rotation pin 88 forward of the normal curvature of the boom arm 42 and provides a clearance area 96. By moving the boom arm/bucket attachment rotation pin 88 forward relative to the normal curvature of the boom arm 42 and by providing the clearance area 96, it is possible to allow the bucket 22 to rotate backward far enough to allow the bucket face opening 90 to rest on the ground 92. The bucket attachment region 84 is constructed to allow attachment to both the forward arm 94 and the bucket linkage 74 to allow for the rotation of the bucket far enough backward to allow the bucket face opening 90 to rest on the ground 92 when the loader/attachment assembly 12 is provided in the storage position 13. In addition, the bucket linkage 74 includes the first bucket linkage arm 78 and the second bucket linkage arm 80 that are provided to generate the degree of rotation of the bucket 22 that provides for the bucket face opening 90 resting on the ground 92.

The bucket 22 can be constructed as a bucket having a wide bucket face opening 90 to provide a large surface area for contacting the ground 92. It is expected that this large surface area will help stabilize and support the loader assembly 20 and the bucket 22. The bucket face opening 90 can include a forward lip 91 and a rearward lip 93 that are generally flattened compared with many prior art buckets in order to enhance stability when the loader assembly 20 and the bucket 22 are provided in the storage position 13. That is, the design of the bucket face opening 90 can be provided to enhance the stability of the loader assembly 20 and the bucket 22. In addition, the configuration of the bucket face opening 90 helps provide a center of gravity for the loader assembly 20 and the bucket 22 provided in the storage position toward the bucket 22 to help maintain stability. Preferably, the center of gravity of the loader assembly 20 and the bucket 22 is provided forward of the vertical line shown in FIG. 2. That is, the center of gravity should be provided beyond the forward edge 95 of the bucket 22 so that the center of gravity is located somewhere over the bucket 22 when provided in the storage position 13.

The first bucket linkage arm 78 and the second bucket linkage arm 80 are constructed to have a length and shape sufficient to provide the desired degree of rotation of the bucket 22. In general, the first bucket linkage arm 78 and the second bucket linkage arm 80 can have a shape that avoids hitting the elbow 94. In addition, for the loader/attachment assembly 12 shown in FIG. 2, it is expected that the bucket can achieve a rotation of at least about 170 degrees. In addition, it is expected that the bucket can achieve a rotation of at least about 180 degrees, and possibly even at least about 190 degrees. It should be additionally appreciated that by increasing the degree of rotation of the bucket 22, it is possible to more conveniently ensure that articles transported in the bucket 22 are emptied by rotating the bucket backward.

An advantage of the loader/attachment assembly 12 is the ability to hide or conceal the hydraulic cylinder lines that operate the hydraulic cylinders. The hydraulic cylinder lines can be hidden within the boom arms 24 and 26. The lift cylinder 46 and the attachment cylinder 48 can be provided as single end ported cylinders when they are ported at one end. For example, the attachment cylinder 48 can be ported at the first attachment cylinder end 68, and lift cylinder 46 can be ported at the second lift cylinder end 62. Accordingly, the hydraulic lines that operate the cylinders can extend through the left boom 24 and the right boom 26, and the lines can communicate between the booms by passing through at least one of the boom connectors. For example, the lift cylinder hydraulic lines can pass through the left boom arm 42 and pass through the boom connector 28 and through the right boom arm to operate the right lift cylinder. Similarly, the attachment cylinder hydraulic lines can pass through the right boom arm and though the boom connector 30 and into the left boom arm 42 to operate the left attachment cylinder 48. The construction of the hydraulic cylinders and the placement of hydraulic lines within the boom arms are described in U.S. application Ser. No. 10/719,677 filed with the United States Patent and Trademark Office on Nov. 21, 2003, the entire disclosure of which is incorporated herein by reference. It should be appreciated that although single end ported cylinders can be used to minimize stress on the hydraulic lines when they extend through the left boom 24 and the right boom 26 and to reduce the length of hydraulic lines needed, conventional hydraulic cylinders can alternatively be used and the hydraulic lines can be connected to both ends of the hydraulic cylinders.

A shown in FIG. 1, the hydraulic lines 49 are shown extending from the tower 44 for attachment to the hydraulic lines 51 provided on the motor vehicle 14. The hydraulic lines 49 can be attached to the hydraulic lines 51 by the couplers 53. A pair of hydraulic lines can be provided on both sides of the loader assembly 20. One pair of hydraulic lines can be provided for operating the lift cylinders and one pair of hydraulic lines can be provided for operating the attachment cylinders. It should be understood that there is no restriction on the arrangement of the hydraulic lines. That is, one pair of hydraulic lines can be provided for extending both the lift cylinders and the attachment cylinders, and another pair of hydraulic lines can be provided for retracting the lift cylinders and the attachment cylinders.

The hydraulic lines can communicate between the left boom 24 and the right boom 26 by passing through one or both of the boom connectors 28 and 30. By passing through the towers, the left and right booms 24 and 26, and at least one of the boom connectors 28 and 30, they hydraulic lines can be concealed within the loader assembly 20. By concealing the hydraulic lines, it is possible to avoid much of the wear on the hydraulic lines that occurs when the hydraulic lines get pinched between the loader assembly and another object and/or when branches or other debris get caught or snagged on the hydraulic lines. While it is desirable to conceal the hydraulic lines within the left and right booms 24 and 26, it should be understood that the lines can be provided exterior to the booms, if desired.

Now referring to FIGS. 3–7, the attachment of the loader assembly 20 to the bracket assembly 40 on the motor vehicle 14 is shown. When the loader assembly 20 is provided in the storage position 13, it can be attached to the motor vehicle 14 by moving the motor vehicle 14 forward so that the tower 44 engages the bracket assembly 40. The hydraulic lines between the loader assembly 20 and the motor vehicle 14 can be attached, and manipulating the lift cylinder 46 and/or moving the motor vehicle 14 forward can be used to fasten the loader assembly 20 to the motor vehicle 14. That is, once the hydraulic lines are attached, the operator can attach the loader assembly 20 to the bracket assemblies 40 and 41 and need not leave the motor vehicle 14. In addition, the loader assembly 20 can be conveniently removed from the motor vehicle 14 and allowed to remain in the storage position 13 until it is needed again on the motor vehicle 14. Accordingly, the loader assembly 20 can be conveniently attached and detached from the bracket assemblies 40 and 41.

Figure 3:
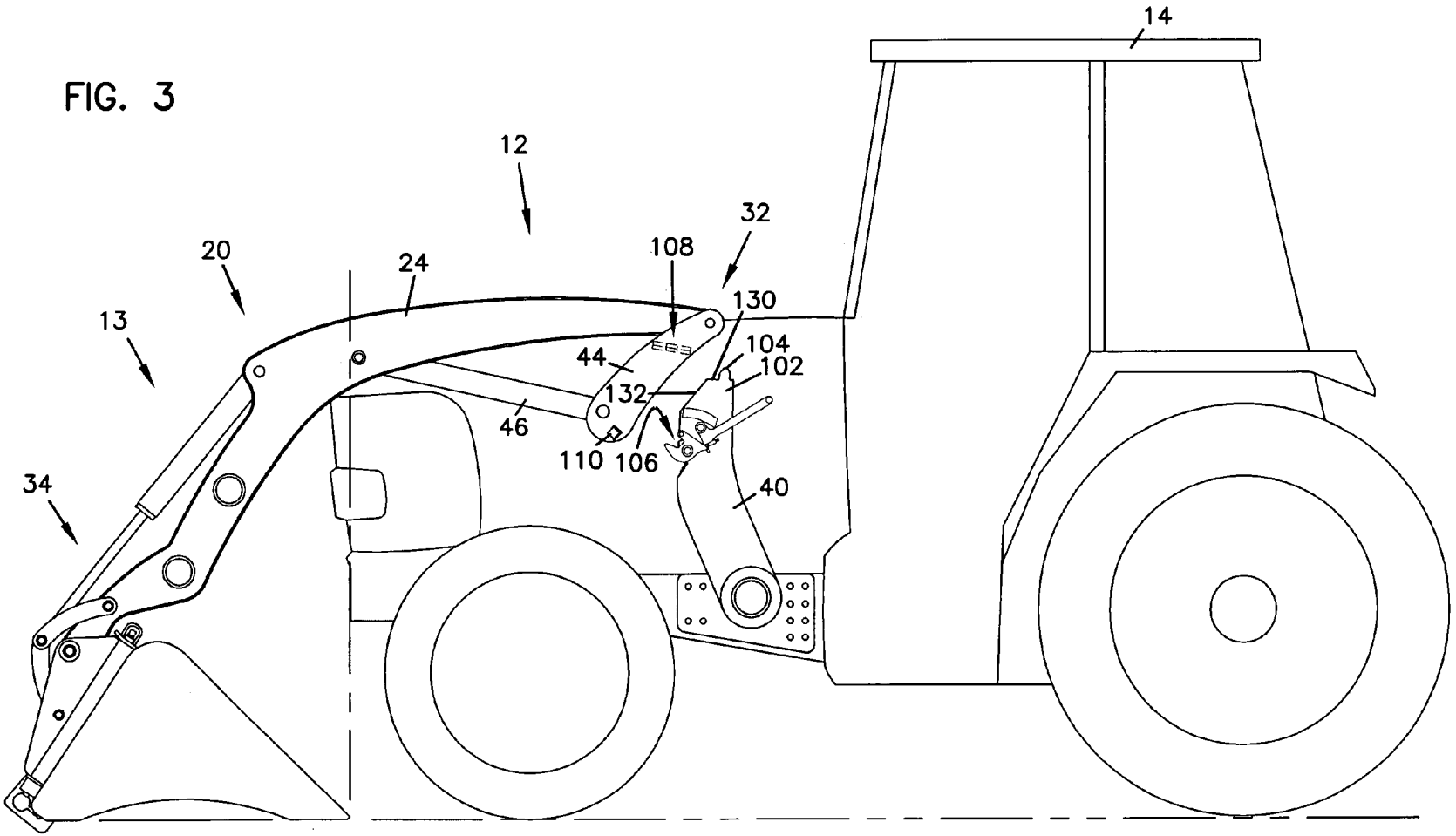
FIG. 3 is a side view of the loader assembly and bucket of FIG. 2 showing a tractor approaching the loader assembly and bucket for mounting.

As shown in FIG. 3, the bracket assembly 40 is attached to the motor vehicle 14. The bracket assembly 40 includes a tower engaging portion 102 that engages and becomes attached to the tower 44. The tower engaging portion includes a guide member 104 and a bar receiving slot 106. The tower 44 includes a guide receiving slot 108 that receives the guide member 104, and a bar 110 that engages the bar receiving slot 106.

Figure 4:
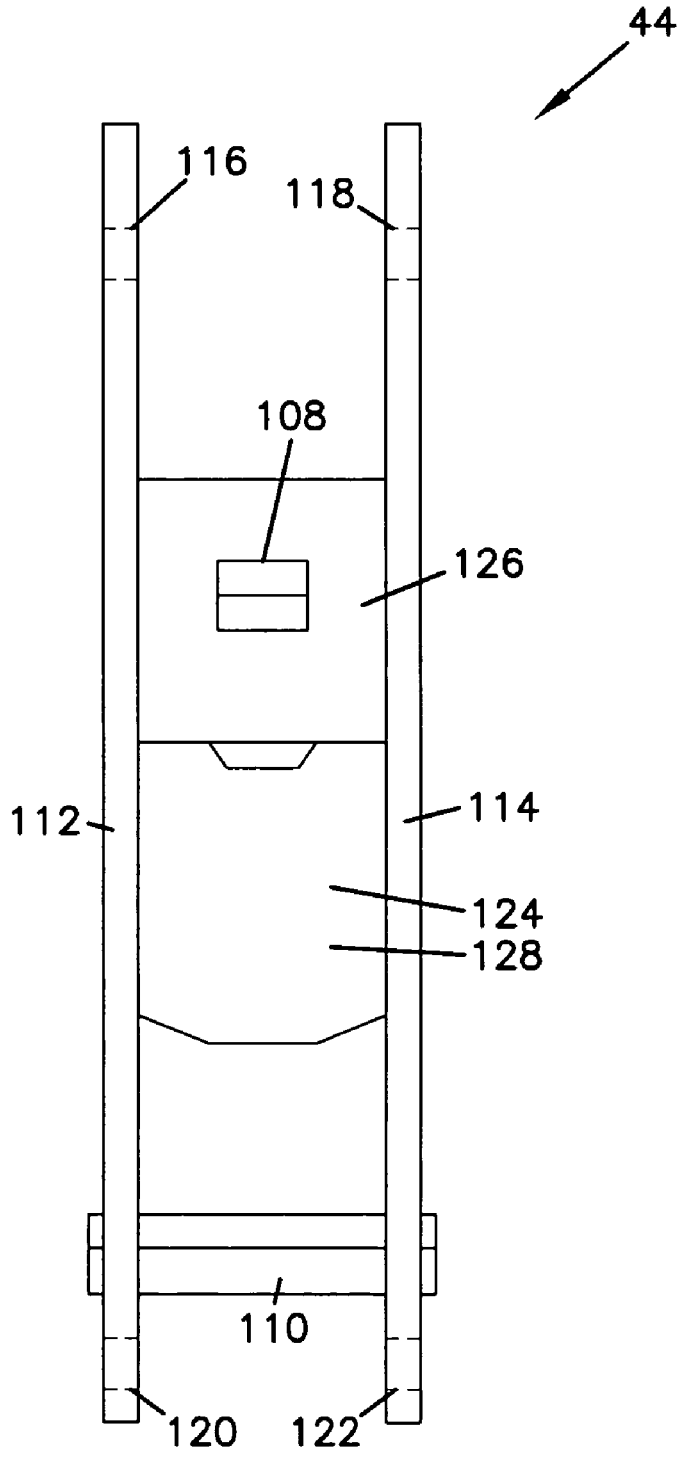
FIG. 4 is a front view of the tower of the loader assembly of FIG. 3.

Now referring to FIG. 4, a partial assembly view of the tower 44 is shown from the front. The tower 44 includes a first tower side member 112 and a second tower side member 114. The bar 110 extends between the first tower side member 112 and the second tower side member 114. The bar 110 can be provided as a bar having a rectangular cross section so that it engages the bar receiving slot 106 when the bar receiving slot 106 is provided as a rectangular slot. Although not shown in FIG. 2, the boom arm/tower rotation pin 58 extends through the first and second boom arm/tower rotation pin openings 116 and 118 provided in the first and second tower side members 112 and 114, respectively. In addition, the left and right lift cylinder/tower rotation pin openings 120 and 122 are provided in the first and second tower side members 112 and 114, respectively, for receipt of the lift cylinder/tower rotation pin 64. The tower 44 includes a tower member spacer 124 having an upper portion 126 and a lower portion 128. The upper portion 126 and the lower portion 128 are constructed to engage the upper surface 130 and the forward surface 132 of the bracket assembly 40. That is, the upper portion 126 can contact the upper surface 130, and the lower portion 128 can contact the forward surface 132. In addition, the tower member spacer includes the guide receiving slot 108 for receipt of the guide member 104.

The tower 44 and the bracket assembly 40 become engaged as the motor vehicle 14 approaches the loader assembly 20 and bucket 22 provided in the storage position 13. It is expected that either the guide member 104 engages the guide receiving slot 108 or the bar 110 engages the bar receiving slot 106. Either may occur first and it is expected that the other engagement will occur as the motor vehicle 14 continues forward and/or as the operator of the motor vehicle causes the lift cylinder to move thereby causing either the bar 110 to engage the bar receiving slot 106 or the guide member 104 to engage the guide receiving slot 108. It should be understood that the lift cylinder 46 can be actuated once the hydraulic lines between the loader/attachment assembly 12 and the motor vehicle 14 are connected. Once the bracket assembly 40 and the tower 44 are sufficiently close together, the operator can attach the hydraulic lines, and operate the cylinders to assist attachment of the loader assembly 20 to the bracket assemblies 40 and 41.

Figure 5:
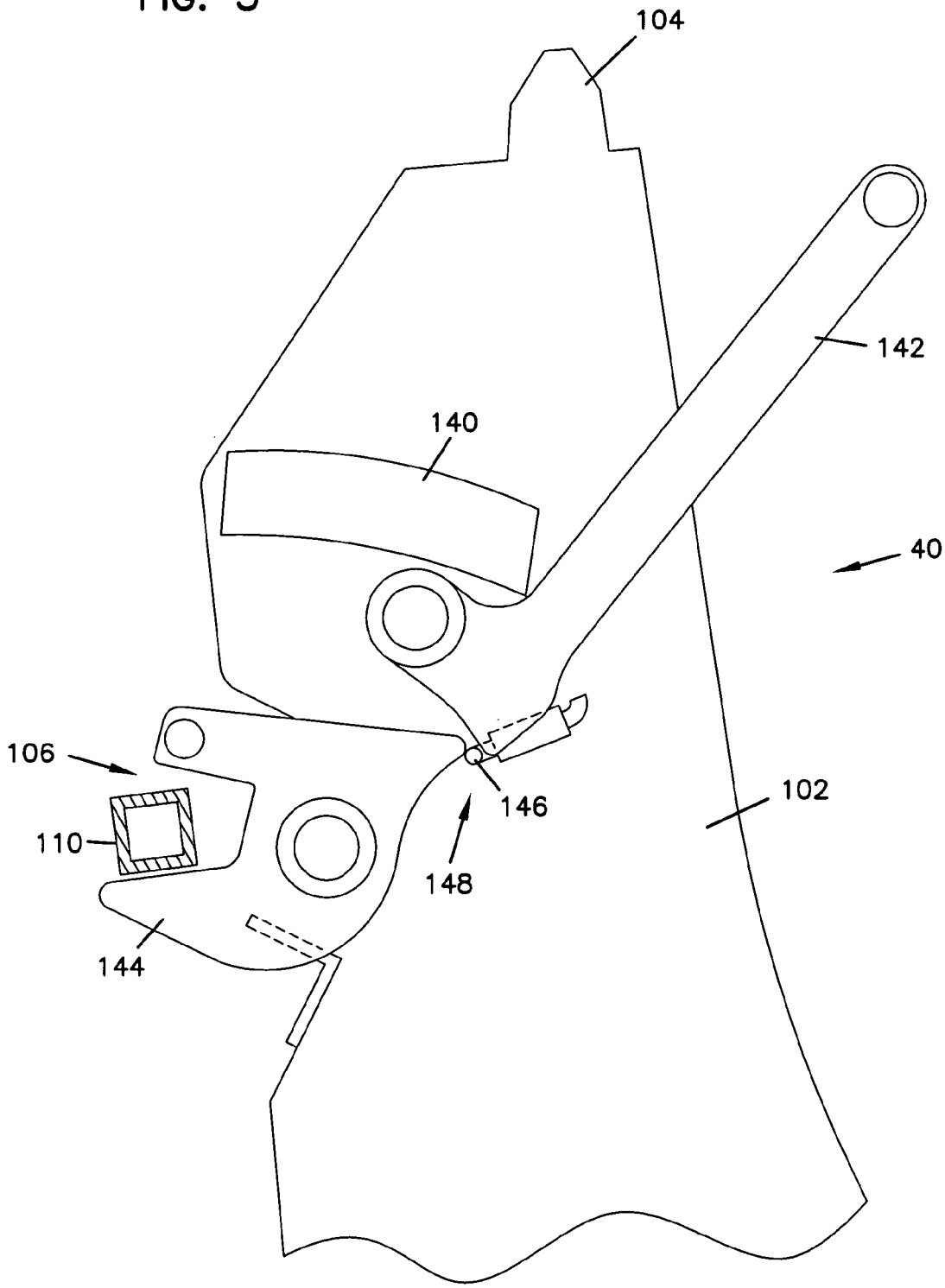
FIGS. 5–7 are side views of a portion of the bracket assembly of FIG. 3 showing how the bracket assembly locks the tower in place.
Figure 6:
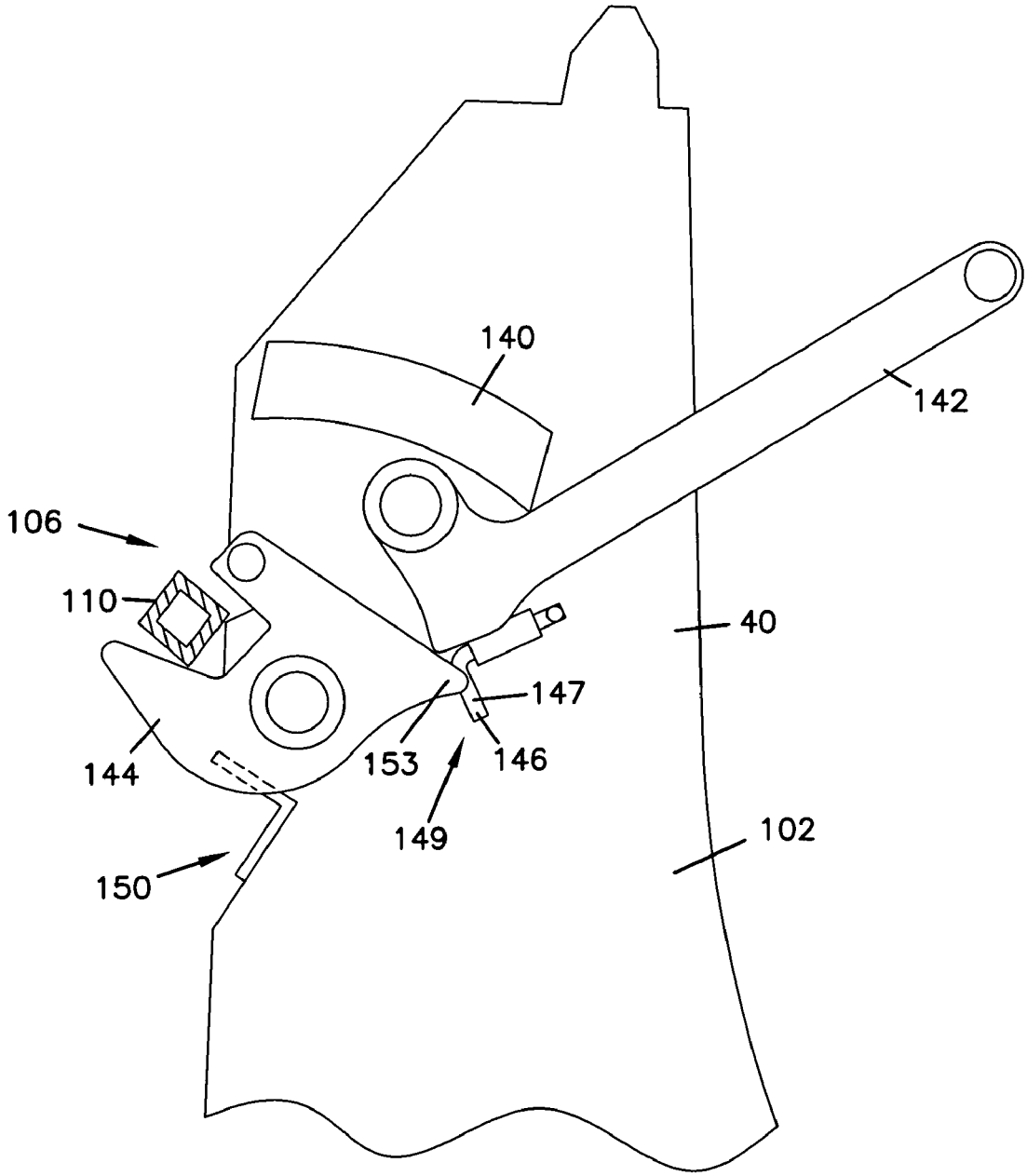
Figure 7:
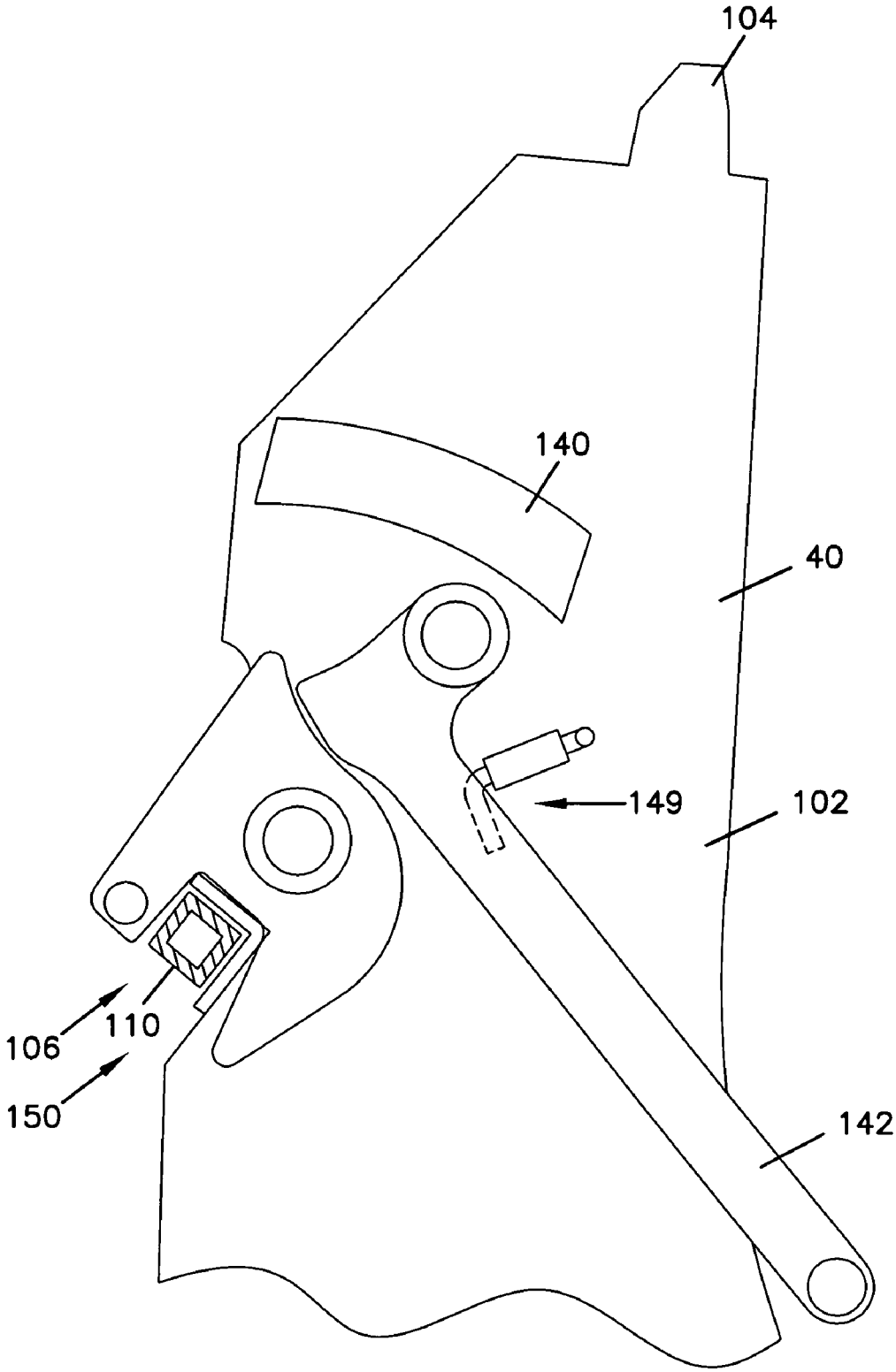

Now referring to FIGS. 5–7, the operation of the bracket assembly 40 is shown. It should be understood that the bracket assembly 41 can be operated similarly. The bracket assembly 40 includes a spacer bar 140, a release handle 142, a catch 144, and a stop 146. The spacer bar 140 can be provided on both sides of the tower engaging portion 102 in order to take up the space between the tower engaging portion 102 and the first and second tower side members 112 and 114 when the tower engaging portion 102 is provided within the tower 44. The release handle 142 can be provided so that it extends on both sides of the tower engaging portion 102. The release handle 142 is provided for releasing the catch 144 in order to allow the catch 144 to rotate. The stop 146 is provided to hold the release handle 142 in a loading position until it is knocked down by the catch 144. The catch 144 can be provided on both sides of the tower engaging portion 102 and includes the bar receiving slot 106.

Once the bar 110 engages the bar receiving slot 106, movement of the motor vehicle and/or the lift cylinder causes the catch 144 to rotate in a manner that depresses the stop 146 as shown in FIG. 6. The stop 146 is provided as an arm 147 that is constructed to rotate between a locked position 148 and an unlocked position 149. When provided in the locked position 148, the arm 147 extends upward and prevents the release handle 142 from falling down. That is, when the arm 147 extends outward or away from the tower engaging portion 102, the release handle 142 is not allowed to rotate in a clockwise direction from the perspective shown in FIG. 6. Once the catch 144 rotates slightly clockwise from the perspective shown in FIG. 6, the arm 147 is knocked down into the unlocked position 149. The catch 144 includes the catch extension 153 that contacts the arm 147 and knocks it down.

The catch 144 can be constructed so that its normal configuration or position is that shown in FIG. 5. In other words, the catch 144 can be constructed so that the bar receiving slot 106 is in position to receive the bar 110. The catch 144 can be constructed to naturally go to the position shown in FIG. 5 by weighting the catch 144 in a particular manner. In addition, a bias such as a spring can be used to cause the catch 144 to go to the position shown in FIG. 5 awaiting receipt of the bar 110 into the bar receiving slot 106.

Continued movement of the motor vehicle and/or the lift cylinder causes the catch 144 to rotate in a counterclockwise rotation from the perspective shown in FIG. 6 until the bar 110 is within the bracket slot 150 as shown in FIG. 7. When in this position, the bracket slot 150 and the receiving slot 106 are generally aligned so that the bar 110 is provided therein. In addition, the release handle 142 drops as a result of gravity and locks the catch 144 in place. Accordingly, the release handle 142 can be constructed to lock the catch 144 in place once the tower 44 is attached to the bracket assembly 40. Prior to locking the catch 144 in place, the guide member 104 engages the guide receiving slot 108. It is expected that the guide member 104 will engage the guide receiving slot 108 prior to the bar 110 engaging the bar receiving slot 106, or soon thereafter.

The tower 44 can be removed from the bracket assembly 40 by lifting the release handle 144 and engaging the stop 146 so that it is provided in the locked position 148. This can be done by hand. The motor vehicle can then be backed away so that the bracket assembly 40 disengages the tower 44. Prior to disengaging the bracket assembly 40 and the tower 44, the loader assembly 20 and the bucket 22 should be provided in the storage position 13. In addition, it may be helpful to manipulate the lift cylinders to help release the tower from the bracket assemblies. The hydraulic lines can be manually detached after the tower 44 is removed from the bracket assembly 40, or at the time the release handle 142 is lifted to allow rotation of the catch 144.

Figure 8:
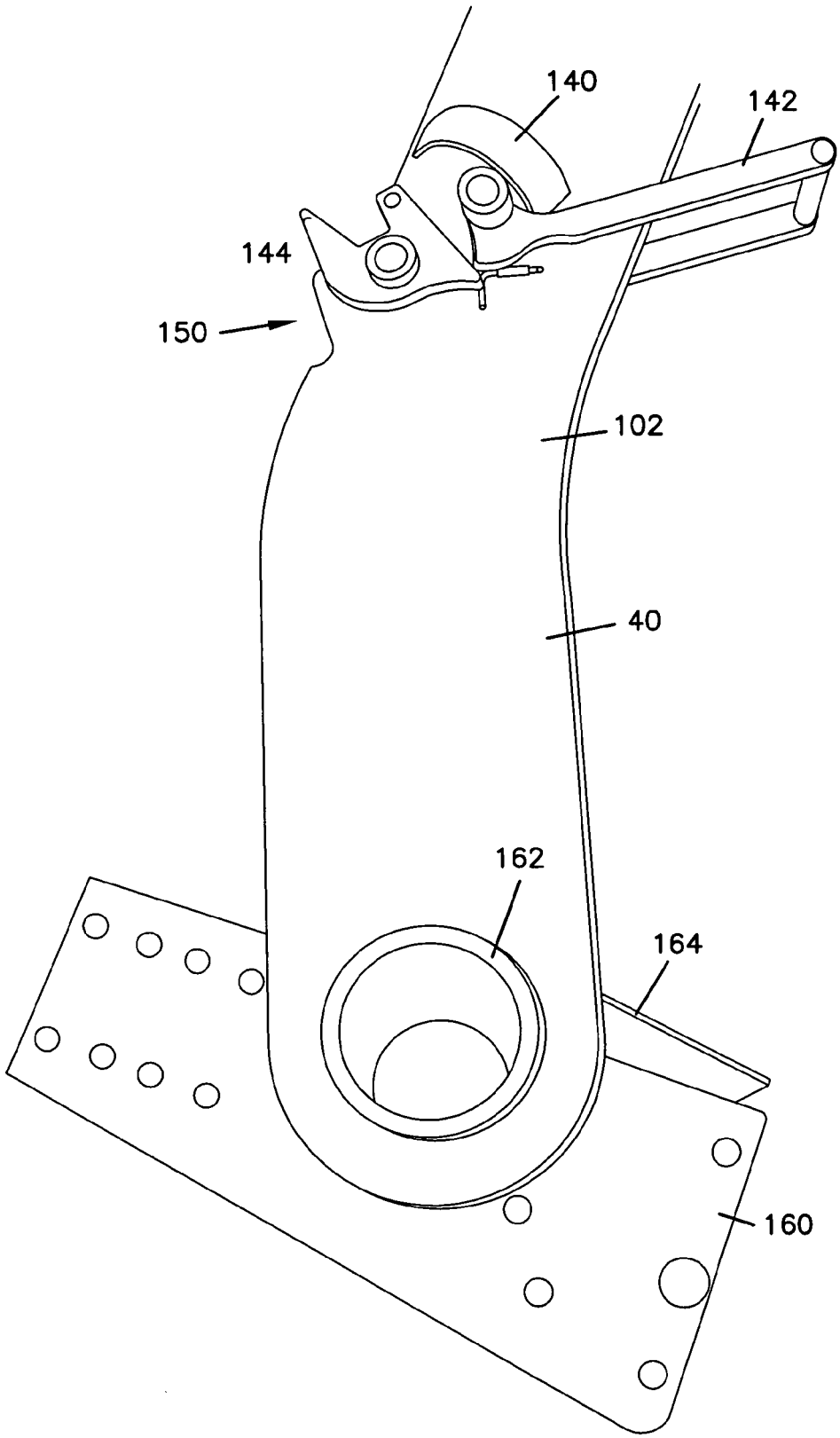
FIG. 8 is a perspective view of the bracket assembly of FIG. 3.

A perspective view of the bracket assembly 40 is shown in FIG. 8. As shown, the release handle 142 can be provided extending along both sides of the tower engaging portion 102. In addition, the spacer bar 140 is provided to help take up space between the tower engaging portion 102 and the corresponding side of the tower. It should be understood that the opposite side of the tower engaging portion 102 can additionally include a spacer bar. Similarly, the catch 144 can be provided on both sides of the tower engaging portion 102. The bracket assembly 40 additionally includes a mounting plate 160 for attachment to the motor vehicle. The mounting plate 160 and the tower engaging portion 102 can be attached together by attachment members 162 and 164.

Although the bracket assembly is shown having the configuration provided in FIGS. 3 and 5–8, it should be understood that other bracket assemblies can be provided accorded to the principles of the invention. It should be understood that the purpose of the bracket assembly is to hold the tower in place during the operation of the loader/attachment assembly.

The above specification, examples and data provide a complete description of the manufacture and use of the composition of the invention. Since many embodiments of the invention can be made without departing from the spirit and scope of the invention, the invention resides in the claims hereinafter appended.

We claim:

1. A loader/attachment assembly comprising:

(a) a bucket comprising a bucket attachment region and a bucket face opening;

(b) a loader assembly comprising:

(i) a left boom comprising a left first boom end constructed for attachment to a left bracket assembly on a motor vehicle, a left second boom end attached to the bucket attachment region, a left lift cylinder, and a left attachment cylinder; and (ii) a right boom comprising a right first boom end constructed for attachment to a right bracket assembly on a motor vehicle, a right second boom end attached to the bucket attachment region, a right lift cylinder, and a right attachment cylinder; and (c) wherein the bucket is constructed to rotate relative to the loader assembly so that when the loader/attachment assembly is provided in a storage position, the bucket face opening rests on the ground;

wherein the bucket is constructed to rotate relative to the loader assembly through an angle of at least 170 degrees.

2. A loader/attachment assembly according to claim 1, wherein the loader/attachment assembly can be provided in a storage position wherein the left first boom end and the right first boom end are extending in a position available for attachment to a left bracket assembly and a right bracket assembly on a motor vehicle by driving the motor vehicle into the loader/attachment assembly so that the left first boom end engages the left bracket assembly and the right first boom end engages the right bracket assembly.

3. A loader/attachment assembly according to claim 1, further comprising a left bracket assembly and a right bracket assembly.

4. A loader/attachment assembly according to claim 1, further comprising hydraulic lines extending through the left boom and the right boom for powering the left lift cylinder, the right lift cylinder, the left attachment cylinder, and the right attachment cylinder.

5. A loader/attachment assembly according to claim 4, wherein the loader assembly comprises at least one boom connector attaching the left boom to the right boom, and at least a portion of the hydraulic lines pass through the boom connector.

6. A combination motor vehicle and loader/attachment assembly comprising:

(a) a motor vehicle having a left side and a right side;

(b) a loader/attachment assembly comprising a bucket comprising a bucket attachment, a left bracket assembly attached to the motor vehicle left side, a right bracket assembly attached to the motor vehicle right side, and a loader assembly, the loader assembly comprising:

(i) a left boom comprising a left first boom end constructed for attachment to the left bracket assembly, a left second boom end attached to the bucket attachment region, a left lift cylinder, and a left attachment cylinder; and (ii) a right boom comprising a right first boom end constructed for attachment to the right bracket assembly, a right second boom end attached to the bucket attachment region, a right lift cylinder, and a right attachment cylinder; and (c) wherein the bucket is constructed to rotate relative to the loader assembly so that when the loader/attachment assembly is provided in a storage position, the bucket face opening rests on the ground and the left first boom end and the right first boom end are in position for attachment to the left bracket assembly and the right bracket assembly;

wherein the bucket is constructed to rotate relative to the loader assembly through an angle of at least 170 degrees.

7. A combination motor vehicle and loader/attachment assembly according to claim 6, wherein the left first boom end comprises a left tower and the right first boom end comprises a right tower.

8. A combination motor vehicle and loader/attachment assembly according to claim 7, wherein the left tower and the right tower each comprise a bar and a guide receiving slot.

9. A combination motor vehicle and loader/attachment assembly according to claim 8, wherein the left bracket assembly and the right bracket assembly each include a guide member for engaging the guide receiving slot, and a bar receiving slot for engaging the bar.

10. A combination motor vehicle and loader/attachment assembly according to claim 6, wherein the loader/attachment assembly can be provided in a storage position wherein the left first boom end and the right first boom end are extending in a position available for attachment to a left bracket assembly and a right bracket assembly on a motor vehicle by driving the motor vehicle into the loader/attachment assembly so that the left first boom end engages the left bracket assembly and the right first boom end engages the right bracket assembly.

11. A combination motor vehicle and loader/attachment assembly according to claim 6, further comprising hydraulic lines extending through the left boom arm and the right boom arm for powering the left lift cylinder, the right lift cylinder, the left attachment cylinder, and the right attachment cylinder.

12. A method for using a loader/attachment assembly, the method comprising steps of:

(a) providing a loader/attachment assembly in a storage position, the loader/attachment assembly comprising:

(i) a bucket comprising a bucket attachment region and a bucket face opening; and (ii) a loader assembly comprising a left boom comprising a left first boom and constructed for attachment to a left bracket assembly on a motor vehicle, a left second boom end attached to the bucket attachment region, a left lift cylinder, and a left attachment cylinder, and a right boom comprising a right first boom and constructed for attachment to a right bracket assembly on a motor vehicle, a right second boom end attached to the bucket attachment region, a right lift cylinder, and a right attachment cylinder; and (iii) wherein the bucket face opening rests on ground and the left first boom end and the right first boom end are in a position for engaging a left bracket assembly on a motor vehicle and a right bracket assembly on a motor vehicle, and wherein the loader assembly does not include a stand for supporting the left second boom end and the right second boom end; and (b) advancing a motor vehicle containing the left bracket assembly and the right bracket assembly mounted thereon until the left second boom end engages the left bracket assembly and the right second boom end engages the right bracket assembly.

13. A method according to claim 12, further comprising a step of attaching hydraulic lines from the motor vehicle to the loader assembly.

14. A loader/attachment assembly comprising:

(a) a bucket comprising a bucket attachment region and a bucket face opening;

(b) a loader assembly comprising:

(i) a left boom comprising a left first boom end constructed for attachment to a left bracket assembly on a motor vehicle, a left second boom end attached to the bucket attachment region, a left lift cylinder, and a left attachment cylinder; and (ii) a right boom comprising a right first boom end constructed for attachment to a right bracket assembly on a motor vehicle, a right second boom end attached to the bucket attachment region, a right lift cylinder, and a right attachment cylinder; and (iii) hydraulic lines extending through the left boom and the right boom for powering the left lift cylinder, the right lift cylinder, the left attachment cylinder, and the right attachment cylinder, and at least one boom connector attaching the left boom to the right boom, and at least a portion of the hydraulic lines pass through the boom connector; and (c) wherein the bucket is constructed to rotate relative to the loader assembly so that when the loader/attachment assembly is provided in a storage position, the bucket face opening rests on the ground.

* * * * *